United States Patent [19]

Looger et al.

[11] 3,990,355

[45] Nov. 9, 1976

[54] ANTI-TANK ROCKET LAUNCHER

[75] Inventors: Lonnie L. Looger, Madison; Wiley B. Vickers, Huntsville, both of Ala.

[73] Assignee: The United States of America as represented by the Secretary of the Army, Washington, D.C.

[22] Filed: Oct. 15, 1974

[21] Appl. No.: 514,693

Related U.S. Application Data

[62] Division of Ser. No. 418,002, Nov. 21, 1973, Pat. No. 3,890,879.

[52] U.S. Cl. ..... 89/1.816; 33/250; 42/1 S

[51] Int. Cl.[2] ..... F41F 3/04

[58] Field of Search ..... 89/1.816, 1.817, 1.813, 89/1.8, 41 B, 41 E; 42/1 S; 33/250, 249

[56] References Cited

UNITED STATES PATENTS

| | | | |
|---|---|---|---|
| 2,685,232 | 8/1954 | Brandt | 89/1.813 |
| 2,710,453 | 6/1955 | Beverly | 33/249 |
| 2,803,880 | 8/1957 | Weaver | 33/249 |
| 3,122,059 | 2/1964 | Choate et al. | 89/1.813 |
| 3,153,856 | 10/1964 | Felix | 33/250 X |
| 3,226,868 | 1/1966 | Mahoney | 42/1 S |
| 3,579,840 | 5/1971 | Heinzel | 33/250 |
| 3,750,529 | 8/1973 | Reed et al. | 89/1.816 X |

FOREIGN PATENTS OR APPLICATIONS

| | | | |
|---|---|---|---|
| 1,517,007 | 2/1958 | France | 89/1.8 |
| 735,414 | 8/1955 | United Kingdom | 42/1 S |
| 791,566 | 3/1958 | United Kingdom | 42/1 S |

*Primary Examiner*—David H. Brown
*Attorney, Agent, or Firm*—Nathan Edelberg; Robert P. Gibson; Charles R. Carter

[57] ABSTRACT

A man-portable anti-tank rocket launcher having rocket storage capability as well as being of minimum weight. The launcher includes a tube for launching the rocket and is provided with end closures for protecting the rocket until launching. The tube has provisions for storing the launcher firing sights until rocket firing thus protecting the sights in transportation and storage until use.

3 Claims, 5 Drawing Figures

ANTI-TANK ROCKET LAUNCHER

DEDICATORY CLAUSE

The invention described herein may be manufactured, used and licensed by or for the Government for governmental purposes without the payment to us of any royalties thereon.

BACKGROUND OF THE INVENTION

CROSS-REFERENCE TO RELATED APPLICATION

This is a division of application Ser. No. 418,002, filed Nov. 21, 1973.

This invention relates to the field of rocket launchers. Recent rocketry development has produced several small caliber rockets that are extremely useful against tanks and other vehicles. These rockets are fired from a man-portable launcher which must be lightweight for battlefield use. Prime consideration must be given to weight problems in this type of launcher design as well as a long shelf life to insure mobility and firepower of the rocket launcher.

SUMMARY OF THE INVENTION

The rocket launcher of the present invention provides a practical launcher for military use in that it is lightweight, storable and includes carrying, stacking and sealing provisions.

The invention may be better understood from the following detailed description taken in conjunction with the accompanying drawings.

DESCRIPTION OF THE PREFERRED EMBODIMENTS

Figure 1:
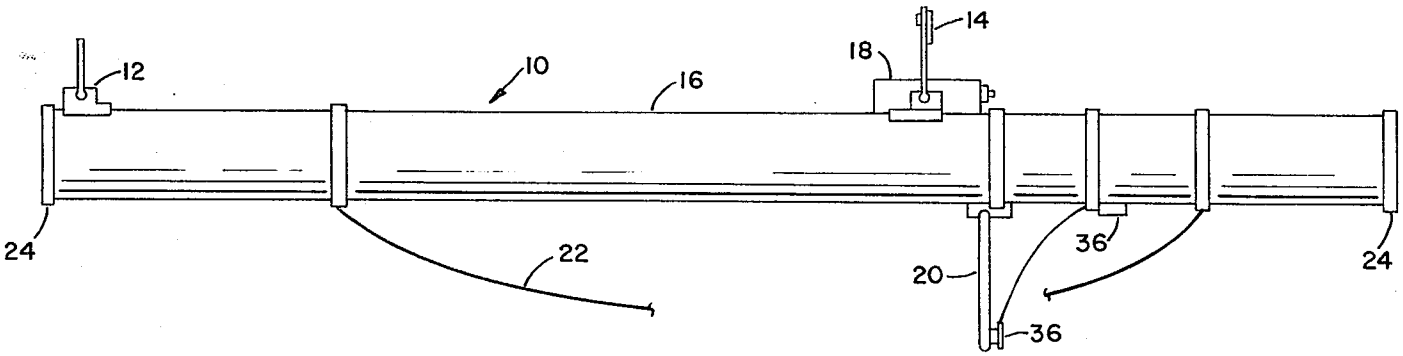
FIG. 1 is an elevation view of a launcher having pivotal sights.
Figure 2:
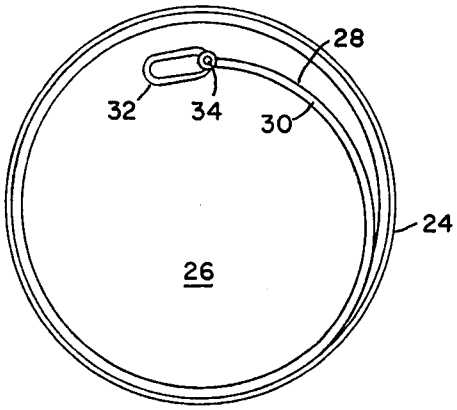
FIG. 2 is an end view of the launcher in FIG. 1 showing one of the launcher end caps.

As shown in FIG. 1 launcher 10 includes a foldup forward sight 12 and a foldup rear sight 14 both pivotally mounted on a tube 16. The tube has a firing mechanism 18 mounted thereon as well as a folding shoulder recoil stop 20 and a shoulder carrying strap 22. End caps 24 close the opposite ends of the tube and thereby protect a rocket carried in the tube. FIG. 2 shows one of the end caps with an end wall 26 provided with scoring 28 which defines a tear strip 30. A tab 32 is provided for manual severance of the tear strip and is attached to the leading end of the tear strip by a hollow rivet 34 formed in the tear strip and extending through an aperture in the tab with a peripheral bead of the rivet overlapping the tab adjacent the aperture.

In the non-use storable condition sights 12 and 14 are folded down from their position shown in FIG. 1 so that they lie along the tube 16 and are protected in transporting and storage. Shoulder stop 20 is folded along the tube and held in this position by nylon hook pile means 36. Several launchers may then be stacked upon each other without damaging individual operating parts. When the launcher is to be operated sights 12 and 14 are folded up and shoulder stop 20 is released from its closed position. Tabs 32 are manually engaged and pulled to sever end walls 26 from their respective end caps 24. The launcher is now in condition for firing.

Figure 3:
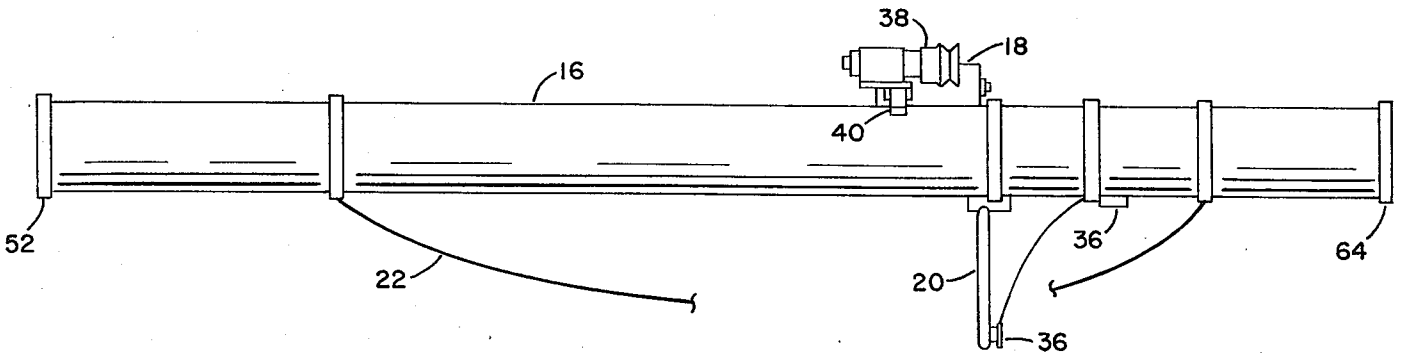
FIG. 3 is an elevation view of a second launcher having removable sights.
Figure 4:
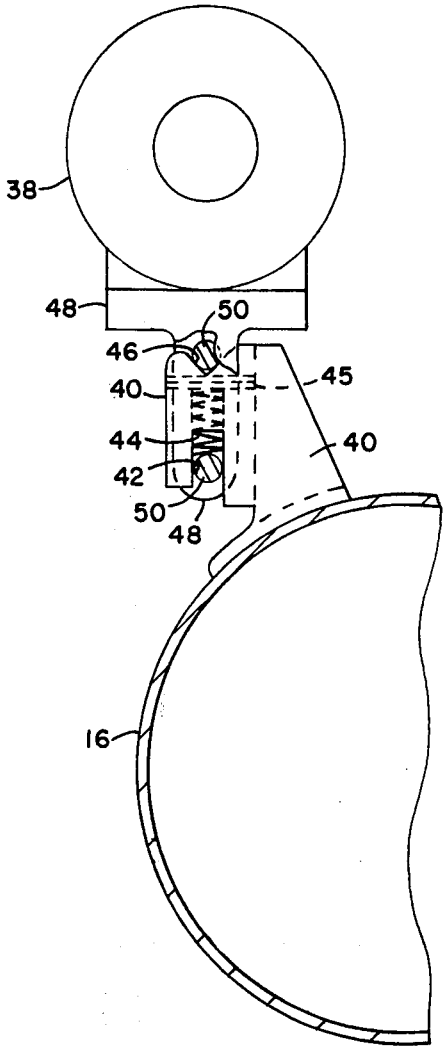
FIG. 4 is a partial view of FIG. 3 showing details of the removable sight mounting means.
Figure 5:
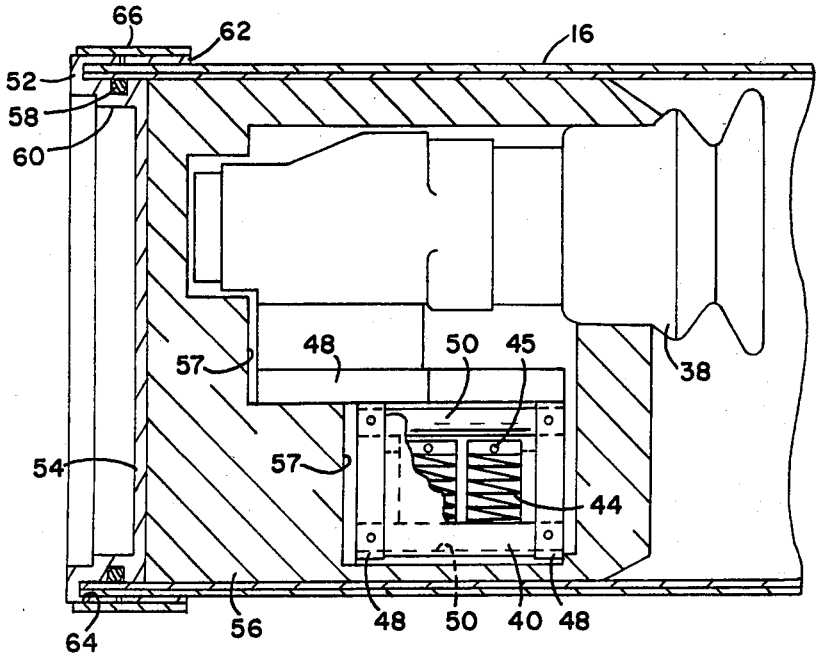
FIG. 5 is a partial sectional view showing the end cap storage of a telescopic sight in the launch tube.

In the embodiment shown in FIGS. 3–5 the launcher is provided with a removable telescope 38. The telescope is removably mounted on a support bracket 40 which is fixedly attached to the tube section 16. The launcher shown in this embodiment includes the firing mechanism 18, shoulder stop 20 and carrying strap 22 as described in the first embodiment. Bracket 40 includes a longitudinal recessed slot 42 on the lower side thereof and compression springs 44 are mounted therein to exert an outward force when loaded. The springs are held in the slot by pins 45. The upper side of bracket 40 is provided with a V-shaped groove 46. Telescope 38 is secured to a frame 48 which includes two cylindrical bars 50 for supporting the telescope on bracket 40. The forward end cap 52 has an end wall 54 which is secured by adhesive means to a polyethylene foam housing 56. The housing is partially split and has a plurality of contiguous cavities 57 for supporting the telescope 38 inside the launcher tube as clearly shown in FIG. 5. An "0" ring 58 is located on the rim 60 of the end cap for sealing the tube. Reference numeral 62 shows an aluminum ring that is secured to the tube 16 to stiffen the end of the tube. When cap 52 is placed on the end of the tube its outer edge 64 abuts the aluminum ring and tape 66 secures the cap to the ring. When a launcher of the modification shown in FIGS. 3–5 is to be used, end cap 52 is removed from the tube section and telescope 38 is taken out of the housing 56. The lowermost bar 50 of the telescope is placed in recessed slot 42 and the springs 44 compressed while the telescope is rotated to a position where the upper bar 50 engages V-shaped groove 46. The telescope is now in position for rocket launching. It is noted that for sake of economy only one telescope could be used for several launchers merely by transferring it to a new launcher. Thus only one telescope would be enclosed in a specifically marked launcher and a number of other launchers would not be provided with a telescope. The rear end cap 64 would be removed and shoulder stop 20 released from its closed position and the launcher is in condition for firing.

We claim:

1. A lightweight man-transportable rocket launcher comprising a tube for storing and launching a rocket; a firing sight removably attached to said tube, said firing sight including a telescope and said tube provided with a sight bracket fixedly mounted thereon for supporting said telescope; means for storing said sight when not in use; a folding shoulder recoil stop and end caps for closing said tube and protecting a rocket in the tube until said launcher is activated for use, said sight bracket provided with a recessed slot on the lowerside thereof, compression springs in said slot for exerting an outward force when loaded, and a V-shaped groove on the upper side of said sight bracket.

2. A rocket launcher as set forth in claim 1 wherein said telescope is secured to a frame and said frame includes upper and lower bars for respectively engaging said V-shaped groove and said recessed slot.

3. A rocket launcher as set forth in claim 2 wherein said means for storing the telescope includes a housing attached to one of said end caps and said housing being provided with a plurality of contiguous cavities for storing the telescope when not in use.

* * * * *